United States Patent [19]

Burger

[11] 4,217,823

[45] Aug. 19, 1980

[54] DRIVE ARRANGEMENT FOR A CHANGEABLE SATELLITE PRINTING MECHANISM

[75] Inventor: Rainer Burger, Augsburg, Fed. Rep. of Germany

[73] Assignee: Maschinenfabrik Augsburg-Nürnberg Aktiengesellschaft (M.A.N.), Augsburg, Fed. Rep. of Germany

[21] Appl. No.: 911,784

[22] Filed: Jun. 2, 1978

[30] Foreign Application Priority Data

Jun. 3, 1977 [DE] Fed. Rep. of Germany ..... 2725030

[51] Int. Cl.[3] ..... B41F 5/14; B41F 13/14; B41F 13/28

[52] U.S. Cl. ..... 101/248; 101/221; 101/179

[58] Field of Search ..... 101/219–222, 101/177–182, 248

[56] References Cited

U.S. PATENT DOCUMENTS

| | | | |
|---|---|---|---|
| 2,248,926 | 7/1941 | Meisel | 101/220 |
| 3,072,050 | 1/1963 | Wolff | 101/221 |
| 3,329,086 | 7/1967 | Pullen | 101/179 |
| 3,452,672 | 7/1969 | Bolza Schunemann et al. | 101/177 |
| 3,769,910 | 11/1973 | Heimlicher et al. | 101/220 |

*Primary Examiner*—William Pieprz

*Attorney, Agent, or Firm*—Frishauf, Holtz, Goodman & Woodward

[57] ABSTRACT

The invention relates to a drive arrangement for a changeable satellite printing mechanism of a rotary printing machine in which at least two main subject matter printing cylinders, that is, cylinders directly carrying subject matter to be printed, or transfer cylinders, can be selectively engaged with a common counter cylinder or with each other, in which arrangement the main subject matter printing cylinders can be selectively coupled with the counter cylinder or with each other while maintaining registry by selective teeth engagement of one or two sets of cylinder gears secured to the drive shafts of the printing cylinders, and at least one of the two subject matter cylinders is rotatable about a predetermined angle upon shifting of their drive shafts.

9 Claims, 5 Drawing Figures

DRIVE ARRANGEMENT FOR A CHANGEABLE SATELLITE PRINTING MECHANISM

BACKGROUND AND PRIOR ART

Such a drive arrangement is known from German Pat. No. 2,024,482 of the assignee of this applicaton. It permits rapid change-over of the printing mechanism and still being able to use cylinder gears which have inclined teeth on one of the subject matter cylinders, resulting in low noise level in spite of the necessary reversal of the direction of rotation in said one of the two subject matter printing cylinders.

Both sets of cylinder gears are constantly in gearing engagement with each other in known drive arrangements. Two coupling clutches are provided therefor by which the cylinder wheels of one of the two subject matter printing cylinders can be selectively coupled either with the drive shaft of the counter cylinder or with that of the other subject matter printing cylinder. To maintain registry, the two clutches are given special shapes so that they can engage only in a predetermined angular position of the drive shaft.

The known drive arrangement can achieve maintenance of registry only between the two main subject matter printing cylinders in spite of these mechanisms, since one of the two subject matter printing cylinders is always fixedly coupled with the counter cylinder. For cooperation with a further satellite printing arrangement, for example to form an overall ten-cylinder printing system, extensive circumferential register correction devices are needed in the known drive arrangement, for example in form of commonly pivotable positioning roller pairs. In the known drive arrangement it is not readily possible to add further subject matter printing cylinders to cooperate with a common satellite counter printing cylinder, which would be necessary to form printing systems of the seven-cylinder or nine-cylinder type.

THE INVENTION

It is an object to provide a drive arrangement for an adjustable satellite printing system of the type described which, while maintaining all the advantages of the known arrangement, is constructed in substantially simpler manner and still, upon change-over between main subject matter printing cylinders, ensures registry between the two main subject matter printing cylinders, while also ensuring registry with other subject matter printing cylinders or printing systems which can be part of the overall printing system for the subject matter to be printed.

Briefly, in accordance with the invention, a slot guide means is provided, associated with each subject matter printing cylinder, and located in or on the printing machine side wall or shield which journals the drive shaft of the printing cylinders, laterally offset from the journals for the drive shafts; upon stopping of the printing mechanism, a guide pin can be introduced in the slot guide means, connecting the guide means and a cylinder. The distance of the pin from the center of the respective cylinder defines a crank arm. Upon shifting of the journals of the cylinders, e.g. by an eccentric, the cylinders will also rotate with respect to a circumferential region facing the counter cylinder. Initially, a respective gear teeth engagement will occur at a predetermined gear-gap position of the cylinder gear. Due to the slot-pin arrangement, rotation of the subject matter printing cylinders about a predetermined angle will result.

As is apparent, the slot guide means could also be secured to the end face surfaces of the printing cylinders or their cylinder gears, and the corresponding guide pins secured to the machine wall or shield.

This drive arrangement also is of low noise level and can be quickly shifted. It avoids, by simple means, that the cylinder wheels rotate at random with respect to each other upon shifting movement of its shafts and that the gear teeth can clash against each other; primarily, however, the arrangement achieves constant maintenance of registry between the various single subject matter printing cylinders of the printing systems without any additional apparatus requirements.

It is particularly desirable if the drive shafts of the two subject matter printing cylinders can be shifted independently of each other and if then the two sets of cylinder gears are so formed that the cylinder gears of one subject matter printing cylinder, when completely shifted away from the counter cylinder in its other end position, does not have gear engagement with the cylinder gears of the other subject matter printing cylinder, or of the counter cylinder, when the other subject matter printing cylinder is engaged with the counter cylinder.

Figure 1:
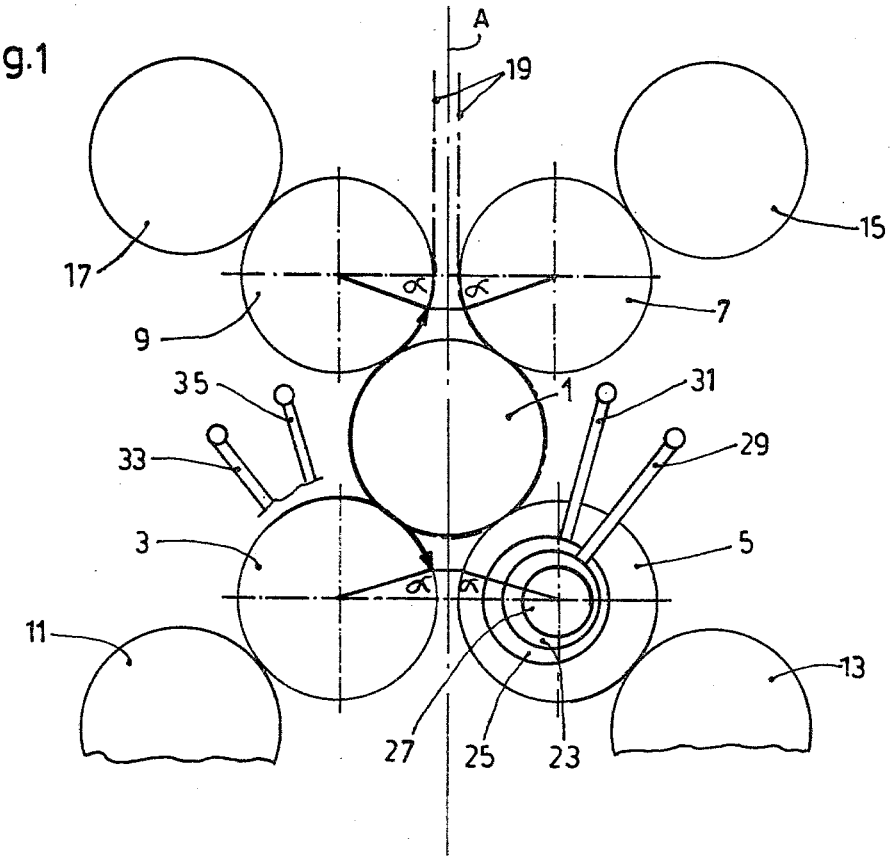
FIG. 1 is a schematic side view of a nine-cylinder printing system set for single-side four-color printing.
Figure 2:
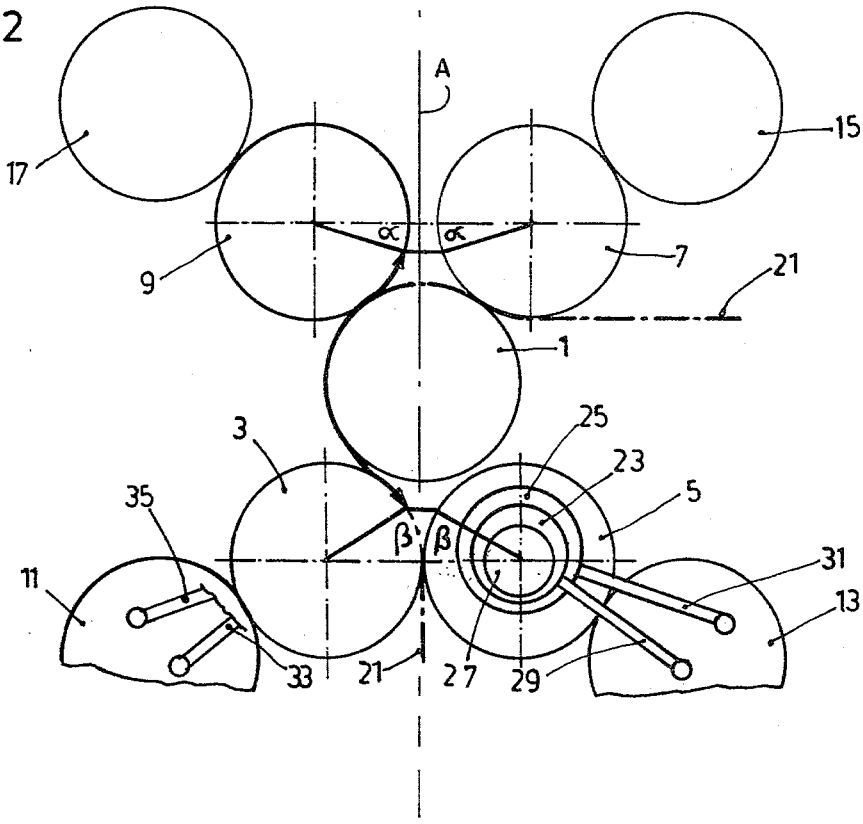
FIG. 2 is a view similar to FIG. 1 in which the system is set for three-color one-side printing and single-color reverse printing.

FIGS. 1 and 2 show a nine-cylinder offset printing system in which four rubber cylinders 3, 5, 7 and 9, forming subject matter printing cylinders, and four plate cylinders 11, 13, 15 and 17 cooperating therewith, are distributed about a satellite cylinder 1 forming a counter cylinder. In FIG. 1, all four rubber cylinders 3, 5, 7, 9 are engaged with the counter cylinder 1. A paper web 19, illustrated chain-dotted, can be printed four times on one side. In FIG. 2, the two rubber cylinders 7 and 9 are engaged with the counter cylinder 1, the other two rubber cylinders 3 and 5 are engaged with each other. In this adjustment, a somewhat differently guided paper web 21 can be printed once on one side and three times on the other side.

Shifting of the rubber cylinders 3 and 5 longitudinally and laterally with respect to the axis of symmetry A between the two positions shown in FIGS. 1 and 2 is done in the example illustrated hereby particularly simple and suitably—as explained with respect to the rubber cylinder 5 and only indicated for rubber cylinder 3—by means of two eccentric bushings 23 and 25 which are nested in each other and which surround a stub shaft 27 on the drive shaft of the rubber cylinder 5. The eccentric bushings 23 and 25 can be shifted simultaneously or sequentially by two positioning levers 29 and 31, moving the rubber cylinder 5 from the position shown in FIG. 1 downwardly and to the left into the position in accordance with FIG. 2, in which rubber cylinder 5 will engage rubber cylinder 3. Rubber cylinder 3 is shifted in completely independent manner by means of an eccentric arrangement downwardly and to the right by the positioning levers 33 and 35, shown only schematically and broken-away from the associated eccenter bushings, which are similar to bushings 23, 25.

Figure 3:
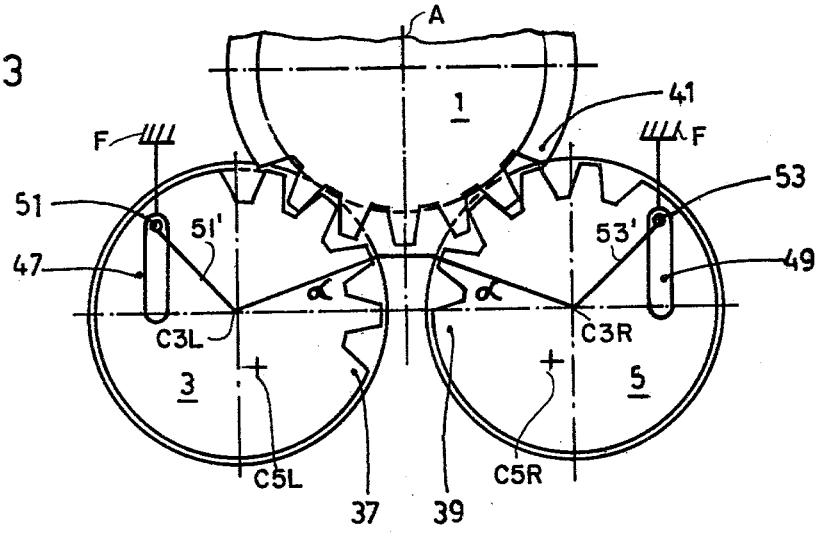
FIGS. 3 to 5 show portions of the cylinder gear sets for the lower half of the printing system according to FIGS. 1 and 2.
Figure 4:
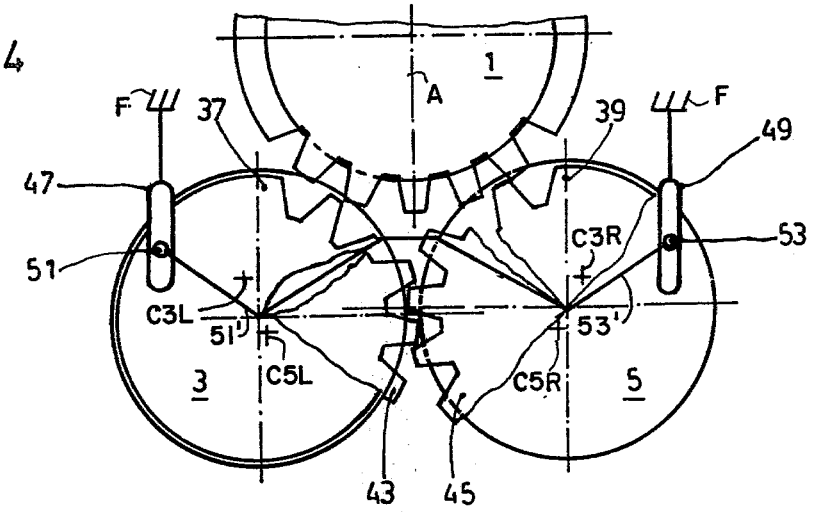
Figure 5:
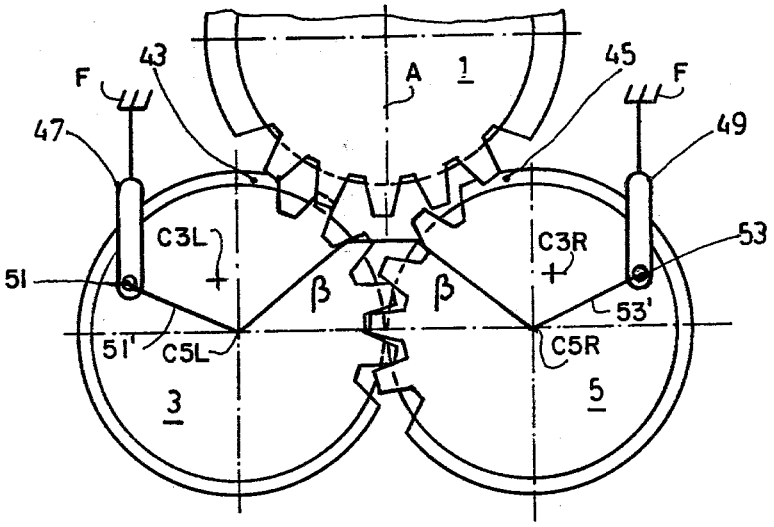

FIGS. 3 to 5 show only the cooperation of the cylinder gears for the printing cylinders of the lower half of the printing system according to FIGS. 1 and 2. In FIG. 3, the rubber cylinders 3 and 5 are in engagement on the satellite counter cylinder 1, in FIG. 4 they are just in an intermediate position in which they contact neither the satellite cylinder 1 nor each other, and in FIG. 5 they engage each other.

The rubber cylinders 3 and 5 are coupled together and with the drive of the system over a number of cylinder gears. To this end, they carry, respectively, a first gear 37 and 39 which in the position according to FIGS. 1 and 3 is in gearing engagement with a gear 41 on the drive shaft of the satellite counter cylinder 1. The drive shafts of the rubber cylinders 3 and 5 carry two further gears 43 and 45 (FIGS. 4, 5) which, when the cylinders are in the position of FIG. 2, are in mutual engagement (see FIG. 5). In the intermediate position according to FIG. 4, a certain overlap of the gearing engagement results; in the transition from FIG. 3 to FIG. 5, the cylinder gears 37 to 41 lose mutual engagement and a new engagement is initiated between the cylinder gears 43 and 45.

The change-over of engagement is guided by a slot-and-pin guide system. A side shield of the printing system—here shown schematically only as part of frame F—has two slotted guide elements 47, 49 secured thereto, located at opposite sides of the shafts of the cylinders, with respect to axis A. To change over the printing system, which is done when it is stopped, two guide pins 51 and 53 are then introduced into the slots. The guide pins 51, 53 are connected to the rubber cylinders 3 and 5. For example attached to the gears 37 and 39 or 43 and 45 resulting in crank arms 51', 53', respectively. These slotted guides 47 and 49, pins 51, 53, and resulting cranks arms 51', 53', control rotation of the respective printing system cylinders 3, 5 with respect to each other as they are shifted longitudinally of axis A while being moved towards each other and ensure gentle engagement of predetermined gear teeth in appropriate gear gaps.

Provision must be made that, upon change-over of the printing system, the respective printing cylinders maintain registry. This means that a point taken from a continuously repeating printing pattern, a recurring or reference point which, in the position according to FIG. 1 for example occurs at the rubber cylinders 3 and 9 and equally also at the rubber cylinders 5 and 7 under an angle $\alpha$ to the horizontal must be in the position of FIG. 2 at the unchanged rubber cylinders 9 and 9 again under the angle $\alpha$, but at the now oppositely mutually engaged rubber cylinders 3 and 5 occur with a new angle $\beta$ to the horizontal, which is unambiguously determined by the changed position of the paper web 21 with respect to the paper web 19. The length of the paper web 21 between the recurring or reference points at the rubber cylinders 9 and 3 must always be equal to half the circumference of the satellite cylinder. A counter directed rotary movement must therefore be superimposed over the shifting movement of the two rubber cylinders 3 and 5 which is counter the direction of rotation of the cylinder 3, and in the direction of rotation of cylinder 5 - see and compare FIGS. 1 and 2. Upon change-over from the angular position $\alpha$ according to FIGS. 1 and 3 to the angular position $\beta$ according to FIGS. 2 and 5, the rubber cylinder 3 must be rotated about a fixed predetermined angular distance ($\beta$—$\alpha$) in counterclockwise direction and the rubber cylinder 5 in clockwise direction.

The slot link guides 47 and 49 in cooperation with the guide pins 51 and 53 are used to this end which thus serve a double purpose. In an intermediate position—see FIG. 4 — they provide that the gear teeth engagement occurs approximately without resistance and rubbing. In the terminal positions - see FIGS. 3 and 5 — the two angles $\alpha$ and $\beta$ are determined, thus also defining the location of the recurring points on the rubber cylinders 3 and 5. Since these three positions of FIGS. 3, 4 and 5 are cleanly separated from each other, it is a simple matter to meet these requirements by suitable shape of the slots in the guides 47 and 49. Since, upon gear engagement (FIGS. 3 and 5), other angular relationships of cylinders 3 and 5 with respect to each other than the angle $\alpha$ and $\beta$ cannot occur, all adjustment possibilities of a rotary printing machine furnished with multiple printing systems have been considered.

Operation: Let it be assumed that the lower half of the printing system, i.e. cylinders 3, 5, 11 and 13, is to be changed over from the position of FIG. 1 to that of FIG. 2. In effect, the centers of the shafts of the cylinders 3, 5 will be shifted from the position C3L, C3R, respectively, to the position C5L, C5R, respectively.

Satellite counter cylinder 1 and the rubber cylinders 3 and 5 are in the position in accordance with FIG. 3. Then, the guide pins 51 and 53 are introduced into the slot guides 47, 49 so that the mutual position of the printing cylinders 1, 3 and 5 and thus also of their cylinder wheels 37 to 47 is initially fixed. The crank arms 51', 53' are defined by the distance of the respective pin 51, 53 from the respective center of the shaft of the respective cylinder 3, 5. Thereafter — simultaneously or successively - the two pairs of shift levers 29, 31 and 33, 35 are operated, effecting shifting of the rubber cylinders 3 and 5, respectively, and simultaneously, rotation of the respective cylinder. The slot guides 47 and 49 force suitable cooperation of the two eccentric bushings 23 and 25 of each of the rubber cylinders 3 and 5. When positioned, the guide pins 51 and 53 are pulled out of the slot guides 47, 49 and the printing system is operable in the new position.

For a change-over of the printing system from the position according to FIG. 2 to that of FIG. 1, these steps are carried out in opposite sequence.

Shifting of the rubber cylinders 3 and 5 can be carried out simultaneously. Upon shifting, the intermediate position of FIG. 4 will be reached from which the smooth engagement of the gears 43 and 45 and, likewise, the resistance-less loss of contact between gears 37, 39 and 41 can be recognized. The rubber cylinders 3 and 5 can however also be shifted sequentially, if desired, without fearing a clashing of the gear teeth. The arrangement is such that the gears of a rubber cylinder in the position according to FIG. 5 will not have gearing engagement with the gears of the rubber cylinder in the position according to FIG. 3, or with the gears of the satellite cylinder 1.

Although it is particularly suitable to secure the slot guides 47, 49 in the printing machine side wall, and to secure the guide pins 51 and 53 on the rubber cylinder gears 37, 39 or 43, 45, the arrangement can clearly also be done reversed, so that the slot guides are secured at the end surfaces of the cylinder gears or of the rubber cylinder itself, and the guide pins on the side wall of the printing apparatus. The guide pins, further, need not necessarily be rigidly secured, so that the magnitude of the guide forces arising upon shifting can be influenced.

I claim:

1. Drive arrangement for a changeable printing mechanism adapted for cooperation with another printing mechanism, of a rotary printing machine having a frame (F);

a counter cylinder (1);

counter cylinder gears (41) on said counter cylinder; at least two printing cylinders (3, 5) carrying subject matter;

means (25, 27) movably journalling the shaft (25) of said cylinders for movement with respect to the frame, the counter cylinder (1) being common to said printing cylinder;

drive means including a gear (37, 39, 43, 45) on said printing cylinders and comprising, in accordance with the invention, means selectively coupling said at least two printing cylinders and gears thereon (a) with the counter cylinder and the counter cylinder gear, or (b) with each other while uncoupled from the counter cylinder, by lateral shifting of the axes of rotation of the printing cylinders and rotation of the respectively shifted printing cylinders in respectively opposite direction to maintain registration of predetermined reference points on the printing cylinders and the counter cylinders, respectively, including means (47, 49) forming a guide slot located laterally shifted with respect to the center of rotation of the respective printing cylinder; and means to guide shifting movement of the printing cylinders including a guide pin located laterally shifted with respect to the center of rotation of the respective printing cylinder and in engagement with the respective guide slot associated with the respective printing cylinder, the distance between the respective guide pin (51,53) and the center of rotation of the respective cylinder forming a crank arm, whereby the coupling of the respective printing cylinder by the respective guide pin means with the respective guide slot will cause controlled rotation upon movement of the movable journaling means, in mutually opposite sense against each other and permit engagement and meshing of the respective gears on said printing cylinders, and the counter cylinder gear, respectively.

2. Arrangement according to claim 1, wherein the at least two printing cylinders (3, 5) are located one, each, symmetrically with respect to an axis of symmetry (A);

and the guide slots (47, 49) are located, with respect to said axis of symmetry, at respectively opposite sides of the centers of rotation of the respective cylinders to control mutually oppositely directed rotary movement of the respective at least two printing cylinders upon movement of the movable journaling means.

3. Arrangement according to claim 2, wherein the drive means (37, 39; 43, 45) on said at last two printing cylinders comprise two separate gears;

one of the gears (37, 39) being engageable with the counter cylinder gear (41) and the other of said gears (43, 45) being positioned for engagement with each other upon movement of the movable journaling means to engage said at least two printing cylinders with each other.

4. Arrangement according to claim 3, wherein the movable journaling means (25, 27) and the respective gears are arranged relative to each other to move, upon movement of the movable journaling means, the gear on one of the at least two cylinders out of engagement with the counter cylinder gear means before engagement can be effected with the corresponding gear on the other of said at least two printing cylinders.

5. Arrangement according to claim 6, wherein the movable journaling means (25, 27) comprises nested eccentric bushings and means (29, 31; 33, 35) connected to and controlling movement of said bushings independently of each other.

6. Arrangement according to claim 1, wherein the movable journalling means (25, 27) comprise journaling the shafts of said at least two printing cylinders and movable independently of each other.

7. Arrangement according to claim 6, wherein the drive means on said at least two printing cylinders comprise a set of gears (37, 43; 39, 45) on each of the printing cylinders and secured thereto;

one of the gears (37, 39) of the sets being adapted for engagement with the counter cylinder gears (41) and the other gear (43, 45) of the set being adapted for engagement with each other;

and wherein the means (25, 27) movably journaling the shafts of the cylinders (3, 5), the guide slots (47, 49) and the guide pins (51, 53) are positioned with respect to each other and with respect to the centers of rotation of the shafts of the respective printing cylinders to effect disengagement of said one gear of the set from the counter cylinder gears (41) before engagement of the other gear of the set with a corresponding other gear of a cylinder is possible, when the means movably journaling the shafts of the cylinder are being moved for shifting the respective positions of said printing cylinders.

8. Arrangement according to claim 1, wherein the guide pins are located at opposite lateral sides with respect to the axis of symmetry, and the respective centers of rotation of the respective cylinders to control, upon movement of the means (25, 27) movably journalling the shafts, limited circumferential rotation of the respective printing cylinder by engagement of the respective guide pin with the respective guide slot.

9. Arrangement according to claim 1, wherein the means (25, 27) movably journaling the shafts effect movement of the shafts in a direction away from the center of rotation of the counter cylinder and, additionally, in a direction towards another of the printing cylinders;

and the guide pins are so located with respect to the center of rotation of the respective cylinder that, in cooperation with the guide slot, the respective cylinder will be moved out of engagement with the counter cylinder and towards another one of the printing cylinders while simultaneously rotating the circumference of said one printing cylinder about a predetermined angle to maintain registration of a reference point on the respective printing cylinder with respect to a reference position in the printing system.

* * * * *